US005419730A

United States Patent [19]

Diresta et al.

[11] Patent Number: 5,419,730

[45] Date of Patent: May 30, 1995

[54] SOUNDING TOY WITH POP-OUT ACTION

[75] Inventors: James Diresta, Woodmere, N.Y.; Russell Emisson, Manhattan Beach, Calif.

[73] Assignee: Toyvision, Santa Monica, Calif.

[21] Appl. No.: 160,977

[22] Filed: Dec. 1, 1993

[51] Int. Cl.[6] ..... A63H 5/00

[52] U.S. Cl. ..... 446/193; 446/197

[58] Field of Search ..... 446/193, 183, 184, 188, 446/192, 180, 181, 197, 213, 475; 124/64

[56] References Cited

U.S. PATENT DOCUMENTS

| | | | |
|---|---|---|---|
| 494,410 | 3/1993 | Carpenter | 446/183 |
| 1,352,047 | 9/1920 | Boje, Jr. . | |
| 1,547,354 | 7/1925 | Baum . | |
| 1,595,441 | 8/1926 | Zenger | 446/188 X |
| 2,668,394 | 2/1954 | Ausw . | |
| 2,688,208 | 9/1954 | Rannister | 446/198 |
| 2,960,794 | 11/1960 | Johns | 446/183 |
| 4,240,224 | 12/1980 | Katzman et al. | 446/197 |
| 5,205,778 | 4/1993 | Koepcke et al. | 446/183 |

*Primary Examiner*—Mickey Yu

*Attorney, Agent, or Firm*—Robert W. J. Usher

[57] ABSTRACT

A sounding toy constructed of a hollow, resilient body having a rigid, tubular valve member extending through a body wall and a toy balloon located inside the body receiving an inner end of the valve member by the neck of the balloon being trapped between two tubular portions of the valve member. Repeated, rapid, squeeze and release of the body everts and reciprocates the balloon through the valve out from and back into the body, inflating the balloon outside the body each time with a startlingly loud and sharp pop or crack.

15 Claims, 2 Drawing Sheets

FIG. 1
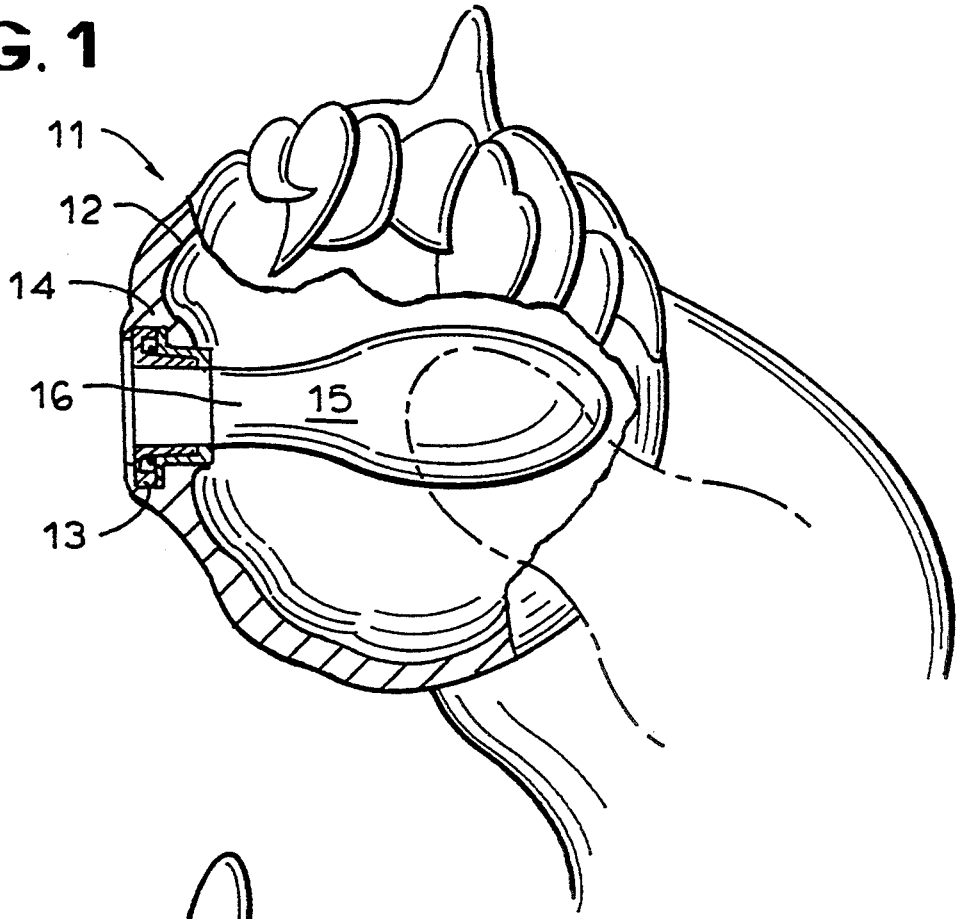
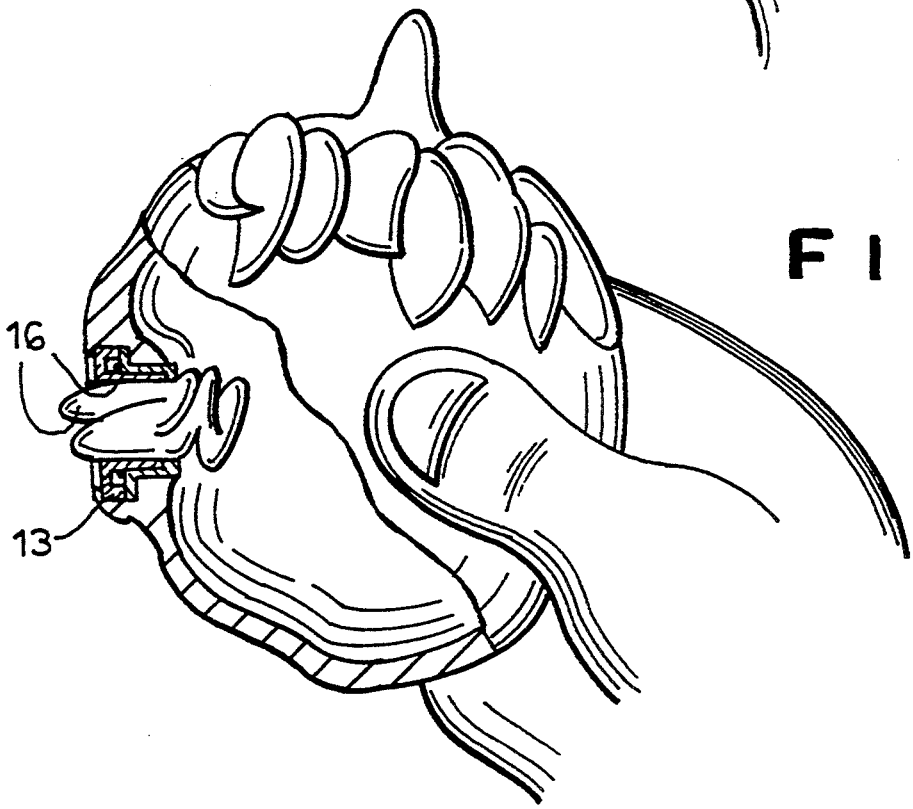
FIG. 2

FIG. 3
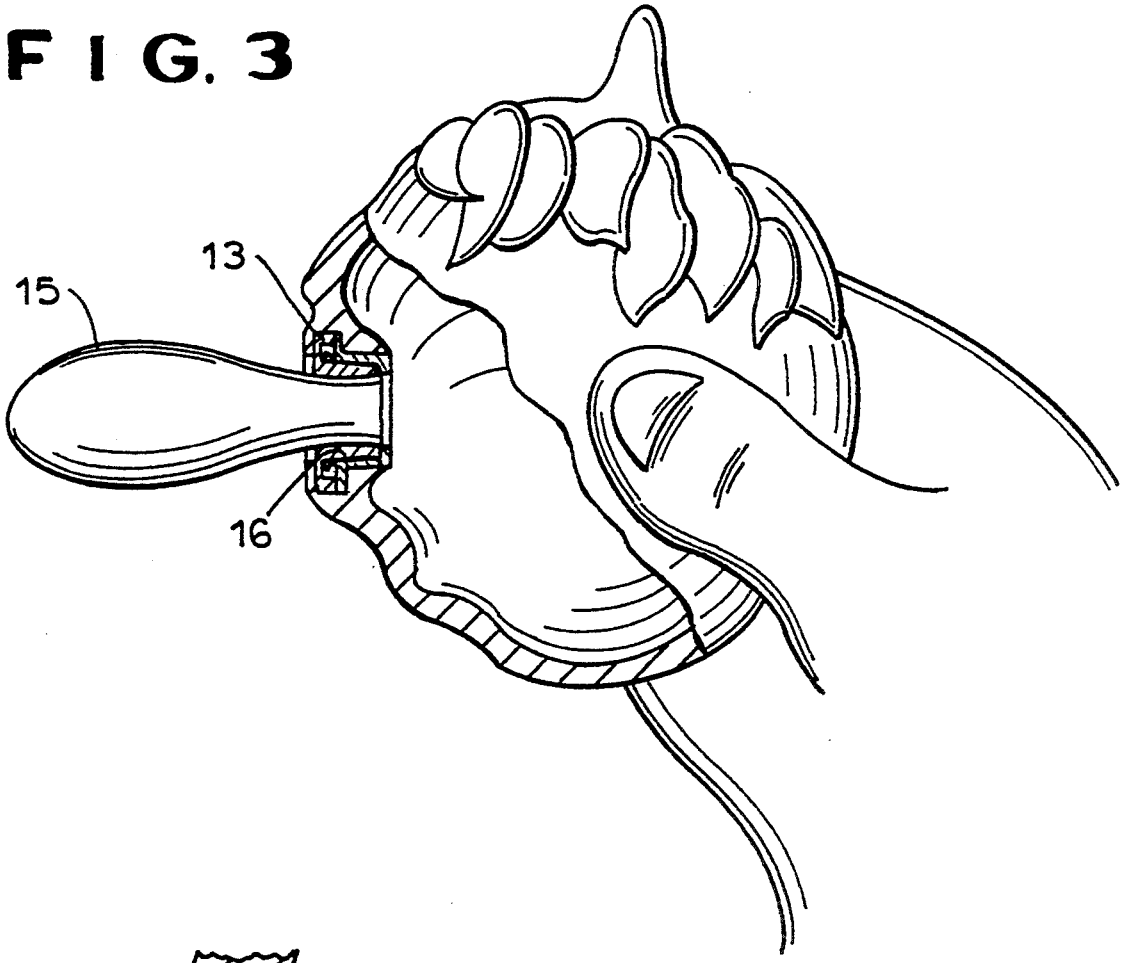
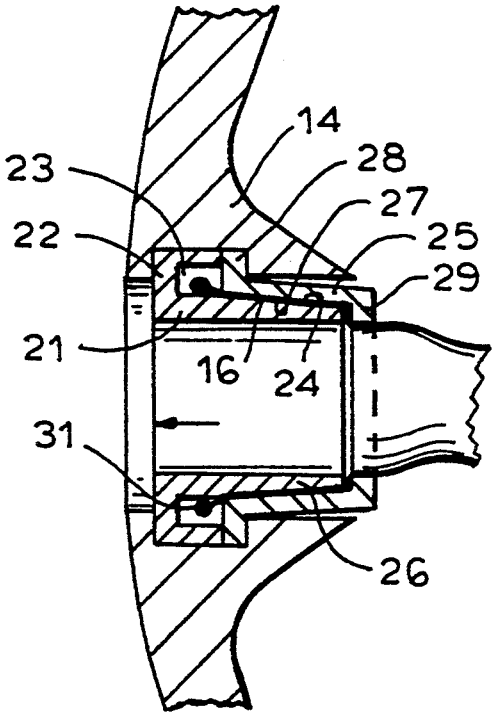
FIG. 4

SOUNDING TOY WITH POP-OUT ACTION

FIELD OF THE INVENTION

The invention relates to a sounding toy with pop-out action and, particularly, to a sounding toy suitable for manual operation by children and having a body from which an air bag, for example, a balloon, pops out while emitting a startlingly loud and sharp pop or crack.

BACKGROUND OF THE INVENTION

There have been many prior attempts over many years to perfect toys having parts which pop out when the hollow body of the toy is manually squeezed. For example, U.S. Pat. No. 494,410 to Carpenter; U.S. Pat. No. 1,352,047 to Boje; U.S. Pat. No. 2,688,208 to Bannister; U.S. Pat. No. 2,668,394 to Auzin; U.S. Pat. No. 2,960,794 to John; and, U.S. Pat. No. 5,205,773 to Koepcke all teach such toys.

However, only the patent to Auzin teaches the simultaneous production of a noise when the toy is squeezed. Auzin relies on a snap action provided by small resilient tensile rings formed by a thickenings in the body wall around orifices which snap respective popped-out projections back into the body.

Such approach is different from that of the present invention and will not produce a startlingly loud and sharp pop or crack, particularly when squeezed by a child.

SUMMARY OF THE INVENTION

An object of the invention is to provide a sounding toy which will reliably evert an air bag out from a body when squeezed by a child while emitting a startling, sharp pop or crack and which will withdraw the air bag back into the body when released.

Another object of the invention is to provide a sounding toy which is adapted for mass production at low cost.

According to one aspect of the invention, there is provided a sounding toy comprising a hollow body providing an internal pressure chamber, a substantially rigid, tubular valve extending through a wall of the body into the pressure chamber, an air bag with a membraneous wall and having a neck portion secured about the valve, receiving an inner end portion thereof in air tight relation with the air bag suspended therefrom in substantial alignment therewith, at least a portion of the body wall defining the pressure chamber being resiliently flexible so that repeated, rapid, manual squeezing and release thereof everts and reciprocates the air bag through the valve out from and back into the body, the air bag having a cross-sectional size at undistended capacity larger than the valve so as to temporarily block the valve during each ejection step, permitting the air pressure to be built up until resistance is overcome so that the air bag is ejected from the valve with a sudden pressure release providing an air jet blast inverting and inflating the air bag outside the body with a loud and sharp pop or crack.

The temporary blockage of the valve is significant in permitting pressure to build up while the tubular configuration releases the air into the air bag as a strongly directional jet blast.

In a preferred embodiment, the air bag is constituted by a standard elastomeric toy balloon.

BRIEF INTRODUCTION TO THE DRAWINGS

An embodiment of the invention will now be described with reference to the accompanying drawings in which:

FIG. 1 is a diagramatic, perspective view, partly cut away, of the sounding toy prior to squeezing;

FIG. 2 is a similar view to FIG. 1 during squeezing, immediately prior to ejection and full eversion of the balloon thereof;

FIG. 3 is a similar view to FIG. 1 immediately after ejection and full eversion of the balloon; and, FIG. 4 is a fragmentary cross-sectional view of the toy showing the valve thereof.

DESCRIPTION OF PARTICULAR EMBODIMENTS

The sounding toy comprises a hollow, spherical resilient body 11 roto-molded from PVC providing an air pressure chamber 12, a tubular valve 13 of rigid plastic material extending through a thickened body wall portion 14 into the pressure chamber, and a toy balloon 15 having a neck portion 16 secured about the valve to receive an inner end portion 17 thereof in air tight relation with the balloon body 18 suspended therefrom in coaxial relation.

The valve 13 comprises a tube portion 21 with an anchoring flange 22 protruding radially outwardly from an outer periphery thereof into a seat formed in the body wall portion 14 thereby anchoring the valve therein. The flange 22 defines an annular channel 23 with an axially inwardly opening mouth extending around the tube adjacent an axially outer end thereof. The wall of the tube portion has an inwardly tapering, conical outer surface 24. A retaining cap 25 for trapping the neck portion 16 of the balloon around the periphery of the valve comprises a sleeve portion 26 having an inner wall surface 27 of complementary taper to said outer surface so that the surfaces trap the balloon neck portion 16 between them. A mounting flange 28 protrudes radially outwardly from an outer periphery of an axially outer end of the sleeve portion adjacent the channel mouth, trapping the lip in the channel. A locating flange 29 is formed on the cap, extending radially inwardly from an axially inner end of the sleeve over an inner axial end of the tube wall with the balloon neck portion trapped between them.

In assembling the toy, the neck portion of the balloon is stretched over the conical surface 24 with the bead 31 at the mouth thereof located in the channel 23. The cap 25 is then force fitted thereon over the stretched balloon neck portion 16 so that the flange 28 covers the channel mouth trapping the bead 31 defining the balloon mouth in the channel. The conical surfaces 24 and 27, of the tubular portion and cap, 24 and 27, respectively, apply a clamping force distributed over a relatively large area of the balloon neck obviating risk of tearing the elastomeric membrane. The sub-assembly so formed is then force fitted into a seat formed in a freshly molded body while still warm and pliable, ensuring effective anchoring therein with the balloon trapped to extend coaxially therefrom across the chamber.

As shown in FIG. 2, when the body is squeezed fairly rapidly, the increasing pressure forces opposed portions of the neck of the balloon into engagement and everts them into and along the tubular portion of the valve until the balloon body which is of significantly greater collapsed width than the diameter of the valve engages in the inner end of the tubular portion in collapsed condition, temporarily blocking the valve, which permits the pressure to increase rapidly until the resistance is suddenly overcome and the entire balloon is ejected from the valve with full eversion thereof as shown in FIG. 4. The sudden pressure release provides a very strong jet blast which everts and inflates the balloon air bag outside the body with a startlingly loud and sharp pop or crack.

When released, the body will resile and the balloon will evert back inside the chamber.

The balloon is a standard "5 inch" balloon made by Pioneer of Ohio, having approximate dimensions in a flat, collapsed condition of 2½ inches including a neck of 1 inch; a neck width of ½ inch and a body width of 1¼ inch. The toy body diameter is approximately 2½ inches. The axial length of the valve assembly is approximately 14 mm and the internal diameter is 10 mm.

We claim:

1. A sounding toy comprising a hollow body providing an internal pressure chamber, a substantially rigid, tubular valve extending through a wall of the body into the pressure chamber, an air bag with a membraneous wall and having a neck portion secured about the valve, receiving an inner end portion thereof in air tight relation with the air bag suspended therefrom in substantial alignment therewith, at least a portion of the body wall defining the pressure chamber being resiliently flexible so that repeated, rapid, manual squeezing and release thereof everts and reciprocates the air bag through the valve out from and back into the body, the air bag having a cross-sectional size at undistended capacity larger than the valve so as to temporarily block the valve during each ejection step, permitting the air pressure to be built up until resistance is suddenly overcome so that the air bag is ejected from the valve, with a sudden pressure release providing an air jet blast inverting and inflating the air bag outside the body with a startlingly loud and sharp pop or crack.

2. A sounding toy according to claim 1 in which the air bag is made of elastomeric material.

3. A sounding toy according to claim 1 in which the valve comprises a tube portion with an anchoring flange protruding radially outwardly from an outer periphery thereof into the body wall thereby anchoring the valve therein, annular retaining means being provided for trapping the neck portion around the periphery of the valve.

4. A sounding toy according to claim 3 in which the retaining means comprises a cap fitted to the tube portion.

5. A sounding toy according to claim 4 in which a wall of the tube portion has an inwardly tapering, conical outer surface and the retaining cap includes a sleeve portion having a wall surface of complementary taper to said outer surface so that the surfaces trap the neck portion between them, means being provided on the cap for mounting the sleeve portion on the valve.

6. A sounding toy according to claim 5 in which the mounting means comprises a mounting flange protruding radially outwardly therefrom and anchored in the body wall.

7. A sounding toy according to claim 6 in which the neck of the air bag has a beaded lip at a mouth and the flange on the tube provides an annular channel with an axially inwardly opening mouth and extending around the tube adjacent an axially outer end thereof, the mounting flange being located at an axially outer end of the sleeve portion adjacent the channel mouth trapping the lip in the channel.

8. A sounding toy according to claim 7 in which a locating flange is formed on the cap to extend radially inwardly from an axially inner end of the sleeve over an inner axial end of the tube wall with the mouth trapped between them.

9. A sounding toy according to claim 1 in which the air bag is constituted by a conventional toy balloon having a body portion inflatable to a generally spherical shape and joined by a narrow neck portion to a mouth with a beaded lip.

10. A sounding toy according to claim 5 in which the air bag is constituted by a conventional toy balloon having a body portion inflatable to a generally spherical shape and joined to a mouth by a narrow neck portion trapped between the said surfaces.

11. A sounding toy comprising:

a hollow body providing an internal pressure chamber, a substantially rigid, tubular valve extending through a wall of the pressure chamber, an air bag with a membranous wall and having a neck portion secured about the valve, receiving an inner end portion thereof in air tight relation with the air bag suspended therefrom in substantial alignment therewith, manually operable means for decreasing the volume and thereby increasing the pressure of the pressure chamber, rapid operation of which, forces a majority of the air bag through the valve out from the body with eversion thereof, the air bag having a cross-sectional size at undistended capacity larger than the valve so as to temporarily block the valve during each ejection step, permitting the air pressure to be built up until resistance is suddenly overcome so that the air bag is ejected from the valve with a sudden pressure release providing an air jet blast inverting and inflating the air bag outside the body with a startlingly loud and sharp pop or crack.

12. A sounding toy according to claim 11 comprising resilient means for restoring the volume of the pressure chamber to a maximum so that repeated, rapid, manual operation and release of the volume decreasing means everts and reciprocates the air bag through the valve out from and back into the body, inflating the air bag outside the body each time with a startlingly loud and sharp pop or crack.

13. A sounding toy comprising:

a hollow body providing an internal pressure chamber, a substantially rigid, annular valve aperture in a wall of the body, an air bag with a membranous wall and having a neck portion secured about the valve aperture, receiving an inner end portion of the valve aperture in air tight relation with the air bag suspended therefrom in substantial alignment therewith, manually operable means for decreasing the volume and thereby increasing the pressure of the pressure chamber, rapid operation of which, forces a majority of the air bag through the valve out from the body with eversion thereof, the air bag having a cross-sectional size at undistended capacity larger than the valve so as to temporarily block the valve during each ejection step, permitting the air pressure to be built up until resistance is overcome so that the air bag is ejected from the valve with a sudden pressure release providing an air jet blast everting and inflating the air bag outside the body with a startlingly loud and sharp pop or crack.

14. A sounding toy comprising:

a hollow body providing an internal pressure chamber, a substantially rigid, tubular valve extending through a wall of the body into the pressure chamber, a toy balloon having an elongate neck portion extending from a body with a cross-sectional size at undistended capacity larger than a valve aperture, the neck portion being secured about the valve receiving an inner end portion thereof in air tight relation with the neck portion extending substantially coaxially therefrom, at least a portion of the body wall defining the pressure chamber being resiliently flexible so that rapid, manual squeezing of the body wall increases pressure forcing opposed portions of the neck of the balloon into engagement and everts them into and along the valve until the air chamber engages the inner end of the valve in collapsed condition initially blocking the valve permitting the pressure to increase rapidly until resistance is suddenly overcome and the entire body of the balloon is ejected from the valve, the sudden pressure release providing a very strong air jet blast which inflates and everts the balloon outside the body with a startlingly loud and sharp pop or crack.

15. A sounding toy comprising:

a hollow body providing an internal pressure chamber, a valve aperture formed through a wall of the body into the pressure chamber, an air bag having a membranous wall and a neck portion extending from a body, the neck portion being secured about the valve aperture in air tight relation with the body within the pressure chamber, at least a portion of the body wall defining the pressure chamber being resiliently flexible so that repeated, rapid, manual squeezing and release of the body wall everts and reciprocates the air bag through the valve out from and back into the body, the manual squeezing increasing pressure, forcing wall portions of the air bag into engagement and into the valve aperture in collapsed condition, the body of the air bag having a cross-sectional size at undistended capacity larger than the cross-sectional size of the valve aperture and the valve aperture being rigid relative to the wall of the air bag so that, in collapsed condition, the air bag initially blocks the valve aperture permitting the pressure to increase rapidly until resistance is suddenly overcome and the air bag is ejected through the valve aperture, the sudden pressure release providing a very strong air jet blast which inflates and everts the air bag outside the body with a startlingly loud and sharp pop or crack.

* * * * *